US009653822B2

(12) United States Patent
Xing et al.

(10) Patent No.: US 9,653,822 B2
(45) Date of Patent: May 16, 2017

(54) CABLE CONNECTOR ASSEMBLY AND METHOD OF MANUFACTURING THE CABLE CONNECTOR ASSEMBLY

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/943,043

(22) Filed: Nov. 17, 2015

(65) Prior Publication Data

US 2016/0141818 A1 May 19, 2016

(30) Foreign Application Priority Data

Nov. 17, 2014 (CN) ..... 2014 1 0650688

(51) Int. Cl.

| | |
|---|---|
| ***H01R 24/00*** | (2011.01) |
| ***H01R 4/70*** | (2006.01) |
| ***H01R 12/53*** | (2011.01) |
| ***H01R 13/506*** | (2006.01) |
| ***H01R 13/629*** | (2006.01) |
| ***H01R 24/62*** | (2011.01) |
| *H01R 107/00* | (2006.01) |

(52) U.S. Cl.

CPC ..... *H01R 4/70* (2013.01); *H01R 12/53* (2013.01); *H01R 13/506* (2013.01); *H01R 13/62938* (2013.01); *H01R 24/62* (2013.01); *H01R 2107/00* (2013.01)

(58) Field of Classification Search

CPC ..... H01R 23/02; H01R 24/60; H01R 24/62; H01R 13/6464; H01R 13/658; H01R 13/6565; H01R 13/6586; H01R 13/562

USPC ..... 439/676, 660, 607.05, 607.5, 607.55, 439/607.58, 447

See application file for complete search history.

(56) References Cited

U.S. PATENT DOCUMENTS

| | | | | |
|---|---|---|---|---|
| 7,614,911 | B2 * | 11/2009 | Hsieh | H01R 13/5845 174/135 |
| 8,517,751 | B1 | 8/2013 | Golko et al. | |
| 2010/0330842 | A1 * | 12/2010 | Cheng | H01R 13/64 439/607.58 |

(Continued)

*Primary Examiner* — Hae Moon Hyeon

(74) *Attorney, Agent, or Firm* — Wei Te Chung; Ming Chieh Chang

(57) ABSTRACT

A cable connector assembly includes a cable (6), a contact module connected with the cable, a shell (3) enclosing on the contact module, an inner insulator (7) enclosing on the shell and front end of the cable, an outer insulator (5) enclosing on the inner insulator, and a cover (4) assembled on the outer insulator. The shell has a mating section on a front end thereof, and the mating section is extending forwards beyond the outer insulator. The outer insulator has a pair of cutouts (51) on opposite walls thereof. The inner insulator defines a pair of projections exposed in the corresponding cutouts of the outer insulator, and the cover is assembled to the inner insulator and the outer insulator by combination with the projections.

19 Claims, 6 Drawing Sheets

(56) References Cited

U.S. PATENT DOCUMENTS

| | | | | |
|---|---|---|---|---|
| 2011/0028038 | A1* | 2/2011 | Luo | H01R 12/62 439/607.58 |
| 2013/0217253 | A1 | 8/2013 | Golko et al. | |
| 2013/0237093 | A1* | 9/2013 | Kamarauskas | H01R 13/2442 439/607.58 |
| 2015/0188261 | A1* | 7/2015 | Wu | H01R 13/6593 439/607.55 |
| 2015/0288107 | A1* | 10/2015 | Wu | H01R 13/6593 439/357 |

* cited by examiner

CABLE CONNECTOR ASSEMBLY AND METHOD OF MANUFACTURING THE CABLE CONNECTOR ASSEMBLY

FIELD OF THE INVENTION

The present invention generally relates to a cable connector assembly, and more particular to a cable connector assembly with an improved cover and insulator.

DESCRIPTION OF PRIOR ART

U.S. Pat. No. 2013/0217253 which published to Golko on Aug. 22, 2013 shows a cable connector assembly, the cable connector assembly has a plug connector comprising an insulative housing molded on contacts and a shell enclosing on the insulative housing. Operator may clasp the shell and pull the cable connector assembly along a direction opposite to the assembling direction, while the friction between the shell and the insulative housing smaller, the shell may be dropped off from the insulative housing. While the friction between the shell and the insulative housing larger, it's not convenient for assembling. When the shell assembled to the insulative housing, the shell can fuse with the insulative housing by local heating, or the shell attached on the insulative housing via glue, and method of local heating will increase the progress. Thermoplastic Elastomeric (TPE) is gradually widely used in the connector area. However, when TPE material is used for making an inner insulator and the shell is metallic, glue is difficult to produce chemical reaction with the TPE material, and a bond therebetween is not firm, the cable connector assembly may be damaged while local heating.

Hence, an improved cover for cable connector assembly is highly desired to overcome the aforementioned problems.

SUMMARY OF THE INVENTION

Accordingly, an object of the present invention is to provide a cable connector assembly with an improved insulator and cover.

In order to achieve the object set forth, a cable connector assembly in accordance with the present invention comprises a cable, a contact module connected with the cable, a shell enclosing on the contact module, an inner insulator enclosing on the shell and front end of the cable, an outer insulator enclosing on the inner insulator, and a cover assembled on the outer insulator. The shell has a mating section on a front end thereof, and the mating section is extending forwards beyond the outer insulator. The outer insulator has a pair of cutouts on opposite walls thereof. The inner insulator defines a pair of projections exposed in the corresponding cutouts of the outer insulator, and the cover is assembled to the inner insulator and the outer insulator by combination with the projections.

Other objects, advantages and novel features of the invention will become more apparent from the following detailed description when taken in conjunction with the accompanying drawings.

DETAILED DESCRIPTION OF PREFERRED EMBODIMENTS

Figure 1:
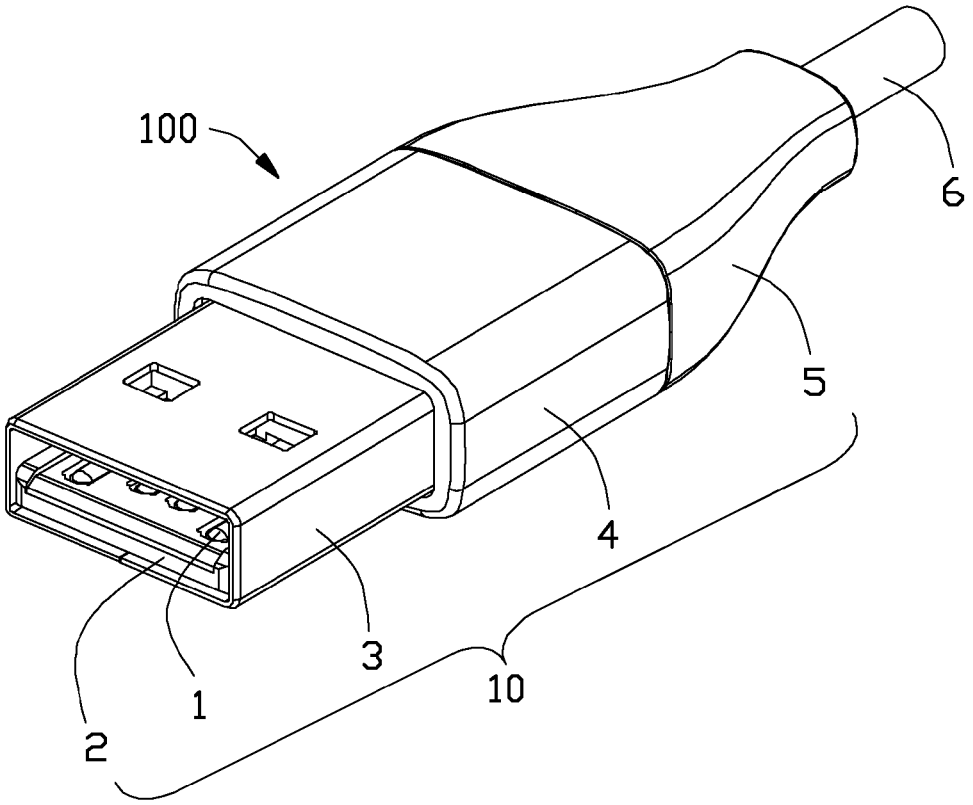
FIG. 1 is an assembled, perspective view of a cable connector assembly in accordance with the present invention.
Figure 2:
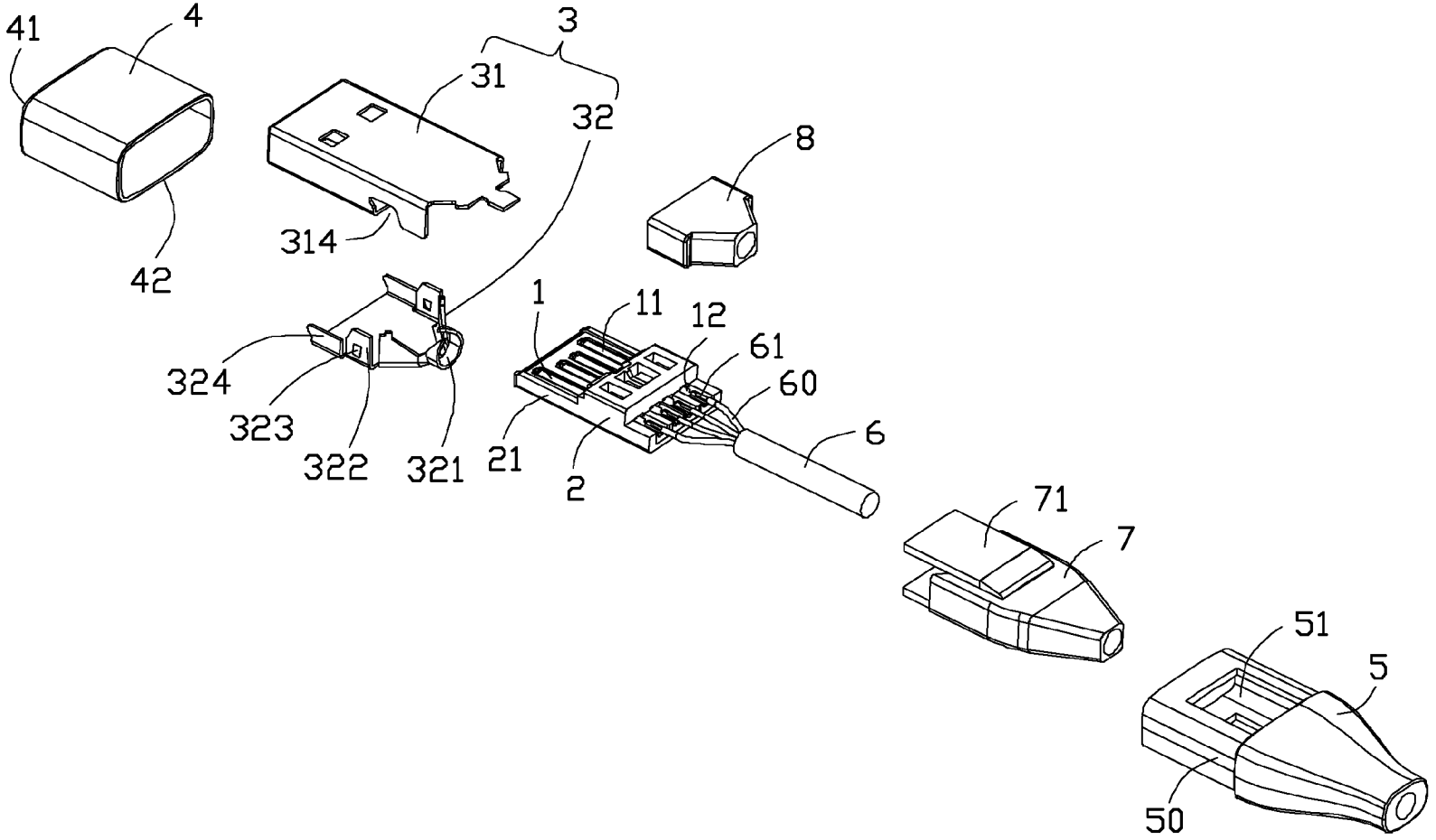
FIG. 2 is an exploded, perspective view of the cable connector assembly shown in FIG. 1.
Figure 3:
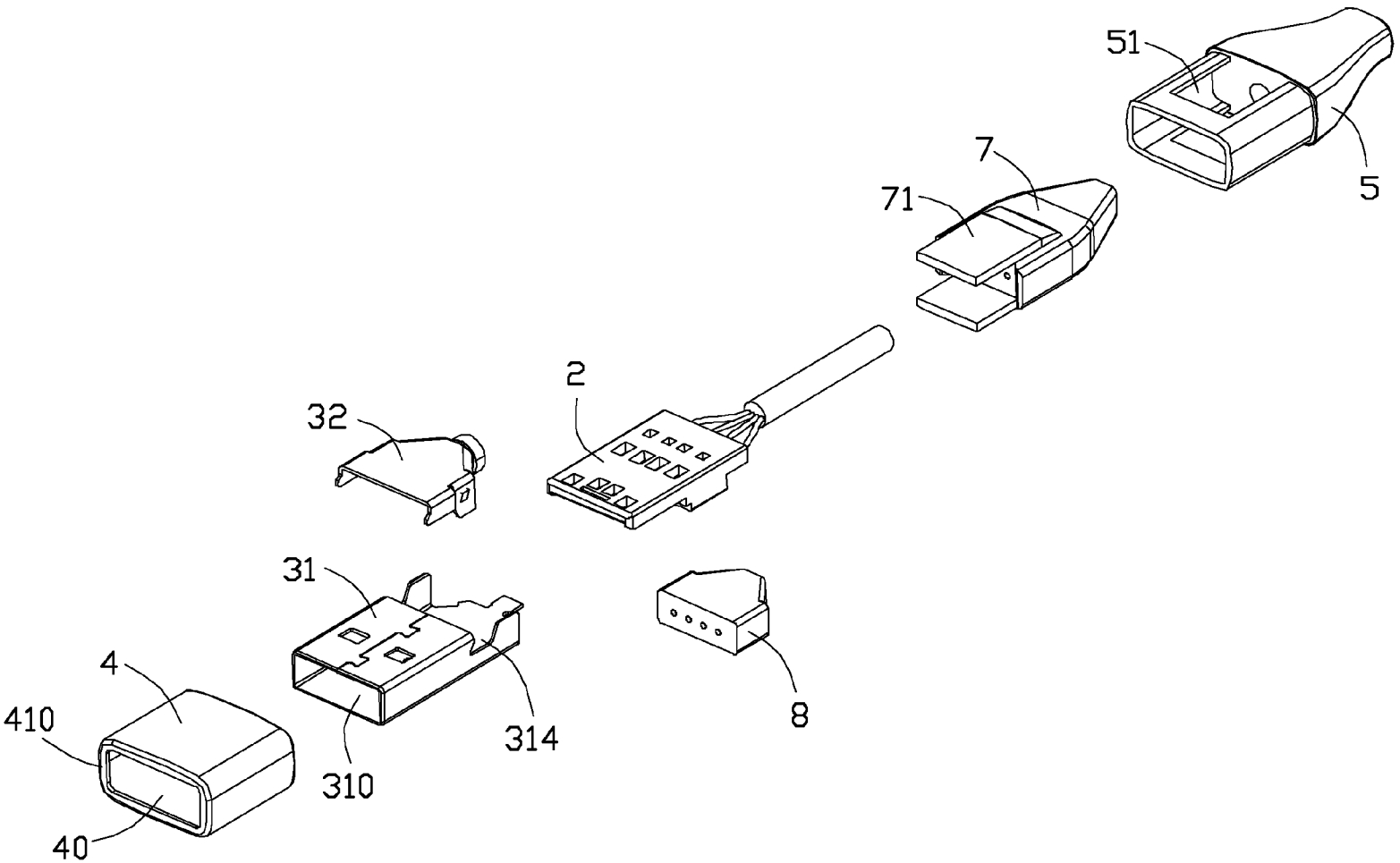
FIG. 3 is similar to FIG. 2, but viewed from another aspect.
Figure 4:
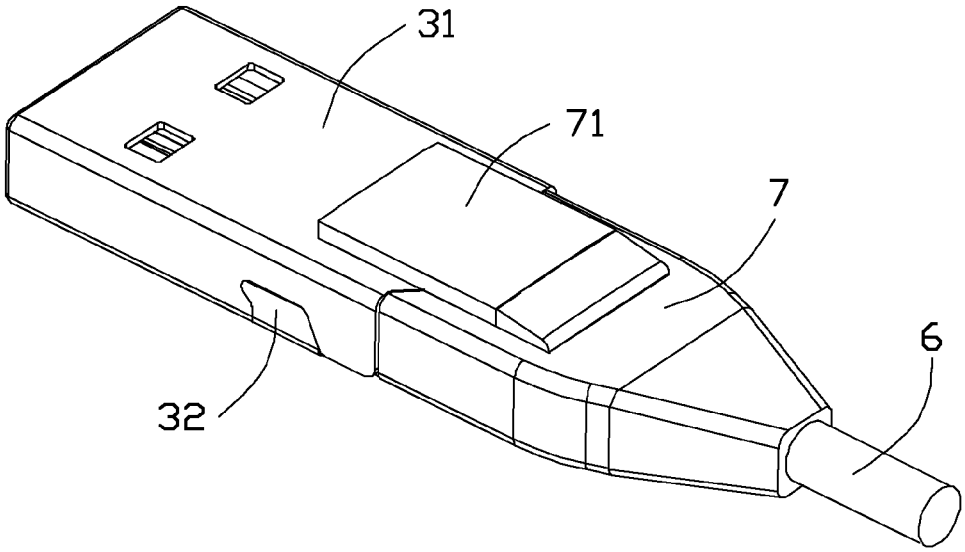
FIG. 4 is a partially assembled view of the cable connector assembly shown in FIG. 2.
Figure 5:
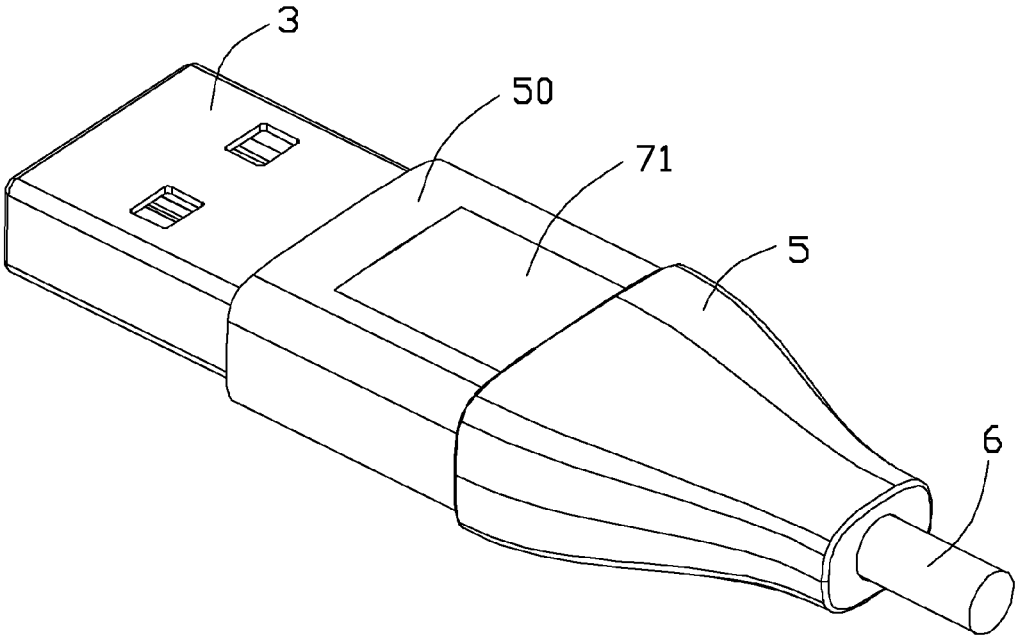
FIG. 5 is a further assembled view of the cable connector assembly shown in FIG. 4.
Figure 6:
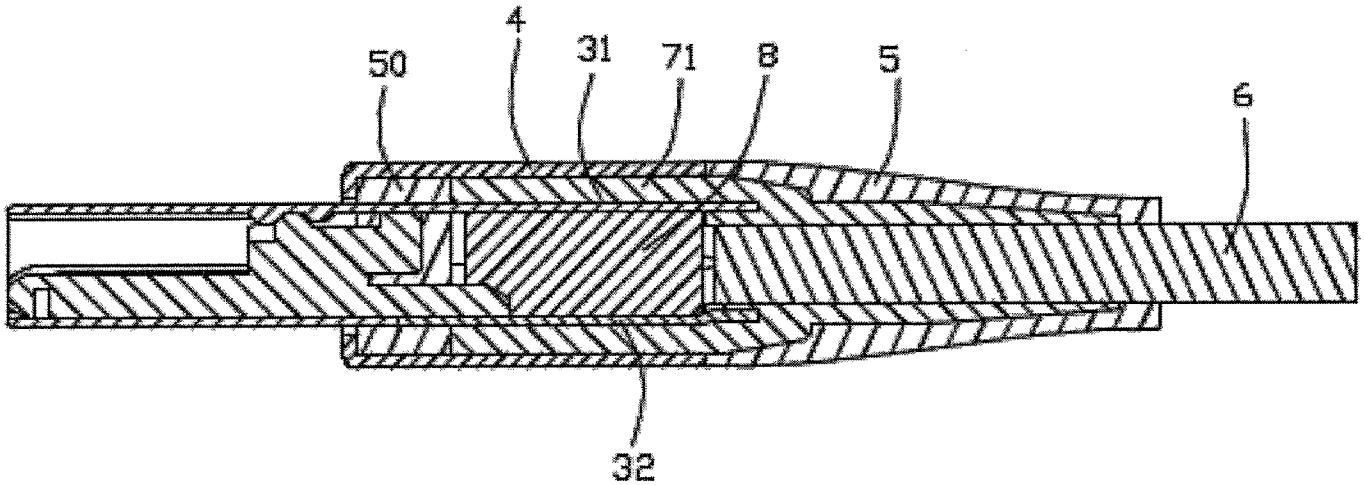
FIG. 6 is a cross-sectional view of the cable connector assembly shown in FIG. 1.

Reference will now be made in detail to the preferred embodiment of the present invention. Referring to FIGS. 1-6, a cable connector assembly 10 in accordance with the present invention comprises a cable 6 and a connector 100 connecting with a front end of the cable 6. The cable 6 comprises a plurality of wires 60, and each wire 60 has a conductor 61 with an exposed front end. The connector 100 comprises a plurality of contacts 1, an insulative housing 2 retaining the contacts 1, a shell 3 shielding on the insulative housing 2, an inner insulator 7 molded on the shell 3, an outer insulator 5 molded on the inner insulator 7, and a cover 4 assembled on the outer insulator 5.

Each contact 1 comprises a contacting portion 11 mating with a complementary connector, and a linking portion 12 soldering with the corresponding conductor 61. The connector 100 also has an insulating block 8 molded on a conjunction area between the linking portion 12 and the conductor 61, hot melt insulation colloid is attached on the soldering area to form the insulating block 8, in other embodiment, the insulating block 8 is over-molded on the soldering area, to prevent the soldering area from being damaged.

The contacts 1 is received in the insulative housing 2, and the spacing between two neighboring contacts is defined according with a predetermined distance. The shell 3 is enclosing on the insulative housing 2 to shield electromagnetic, and comprises a top shell 31 and a bottom shell 32 assembled together, the top shell 31 defines a pair of concave portions 314 on both sides, the bottom shell 32 defines a pair of convex portions 324 engaging with the corresponding concave portion 314 and a pair of fixing portions 322 latching with the top shell 31. Each fixing portion 322 defines a barb 323, the top shell 31 is assembled with the bottom shell 32 via the barbs 323 and the convex portions 324. The bottom shell 32 defines a crimping portion 321 for riveting the cable 6, the crimping portion 321 is defined for maintaining the relative position between the end of the cable 6 and the shell 3, and also can protect the wires 60 not be pulled badly.

The inner insulator 7 is molded on the shell 3, and a pair of opposite projections 71 are defined on a front segment of the inner insulator 7, the two projections 71 are horizontal and symmetrical. The inner insulator 7 is partially enclosed on the shell 3 and the cable 6. Then the outer insulator 5 is enclosed on the inner insulator 7, the outer insulator 5 defines a mounting portion 50 on a front section thereof, the mounting portion 50 defines a pair of cutouts 51 aligned with and receiving the corresponding projections 71, and the projections 71 are exposed out to an exterior via the cutouts 51. Notably, the inner insulator 7 and the outer insulator 5 may be secured to each other via engagement of the projection 71 within the corresponding cutout 51. Understandably, other interengaging structures on the inner insulator 7 and the outer insulator 5, e.g., hooks vs. notches, may also provided for fixation between the inner insulator 7 and the outer insulator 5 in the front-to-back direction. The shell 3 has a mating section 310 extending forwardly out of the outer insulator 5. The outer insulator 5 is made of Thermoplastic Elastomeric (TPE) material, the inner insulator 7 is made of thermoplastic resin material including Nylon or polypropylene or ABS/PC.

The mounting portion 50 is used for positioning the cover 4, the cover 4 comprises a front end 41 and a rear end 42 opposite to each other, a passageway 40 is defined along a front-to-back direction to received the mounting portion 50. The front end 41 defines a flange 410 extruding towards the passageways 40, when the flange 410 is abutting against the mounting portion 50 of the outer insulator 5, the cover 4 is assembled to a predetermined position of the outer insulator 5. The cover 4 is assembled to the outer insulator 5 by passing through the shell 3 from the mating section 310 along the front-to-back direction, and fixed on the mounting portion 50 via glue. The cover 4 is made of aluminum alloy material, and the adhesiveness between the inner insulator 7 and the glue is larger than that between the outer insulator 50 and the glue.

As the outer insulator 5 made of TPE material, the outer insulator 5 is difficult to react with glue, thus the cover 4 made of aluminum alloy material is difficult to stick on the outer insulator 5 via the glue. However, the projections 71 made of thermoplastic resin material can react with glue easily, thus the cover 4 can be fastened on the inner insulator 7 by the glue attached on the projections 71.

Te method for manufacturing the cable connector assembly, comprising the steps of: (1) providing the cable 6 comprising a plurality of wires 60 and a plurality of exposed conductors 61; (2) providing a contact module 21 comprising a plurality of contacts 1 and the insulative housing 2 retaining the contacts 1, each contact having the linking portion 12 at least partially exposed out of the insulative housing 2; (3) connecting the linking portions 12 of the contacts 1 with the corresponding conductors 61 electrically; (4) providing a shell 3 comprising the top shell 31 and the bottom shell 32, the top shell 31 assembled to the bottom shell 32 to enclose on the insulative housing 2; (5) forming the inner insulator 7 on front end of the cable 6 and the shell 3 by over molding, a pair of projections 71 formed on the inner insulator 7; (6) over molding the outer insulator 5 on the inner insulator 7, and the projections 71 exposed in the corresponding cutouts 51 of the outer insulator 5; (7) providing glue on the projections 71, then the cover 4 enclosing on the outer insulator 5, and the cover 4 attached on the projections 71 of the inner insulator 7 via glue.

The present cable connector assembly can overcome the difficulty of the metal bonding with thermoplastic elastomeric material via the glue, and the appearance of the cable connector assembly will not be destroyed in manufacturing process.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable connector assembly, comprising:

a cable;

a contact module connected with the cable;

a shell enclosing on the contact module, the shell having a mating section on a front end thereof;

an inner insulator enclosing on the shell and a front end of the cable;

an outer insulator enclosing on the inner insulator and having at least one cutout on one wall thereof, the mating section extending forwards beyond the outer insulator; and a cover assembled on the outer insulator;

wherein the inner insulator defines at least one projection exposed in a corresponding cutout of the outer insulator, and the cover is assembled to the inner insulator and the outer insulator by combination with the at least one projection.

2. The cable connector assembly as recited in claim 1, wherein the cover is fixed on the projection of the inner insulator via glue.

3. The cable connector assembly as recited in claim 2, wherein the adhesiveness between the inner insulator and the glue is larger than that of the outer insulator and the glue.

4. The cable connector assembly as recited in claim 2, wherein the cover is made of metallic material.

5. The cable connector assembly as recited in claim 2, wherein the outer insulator and the inner insulator are plastic and made of different material.

6. The cable connector assembly as recited in claim 2, wherein the outer insulator is made of Thermoplastic Elastomeric material.

7. The cable connector assembly as recited in claim 6, wherein the inner insulator is made of thermoplastic resin material including Nylon or polypropylene.

8. A method for manufacturing a cable connector assembly, comprising the steps of:

connecting a contact module with a cable;

enclosing a shell on the contact module;

over-molding an inner insulator on a front end of the cable and the shell and forming at least one projection on the inner insulator;

over-molding an outer insulator on the inner insulator while exposing the at least one projection to an outside of the outer insulator;

applying glue on the at least one projection and attaching a cover on the outer insulator via the glue applied on the at least one projection of the inner insulator.

9. The method as claimed in claim 8, further including another projection located opposite to the projection and adhered to the cover via said glue.

10. The method as claimed in claim 8, wherein the outer insulator is made from Thermoplastic Elastomeric (TPE) material while the inner insulator is made of thermoplastic resin material including Nylon or polypropylene.

11. A cable connector assembly comprising:

an insulative housing;

a plurality of contacts disposed in the housing with front contacting section and rear soldering section along the front-to-back direction;

a cable having a plurality of wires respectively mechanically and electrically connected to the rear soldering sections of the corresponding contacts, respectively;

a metallic shell enclosing the housing;

an inner insulator surrounding a rear portion of the shell and a front portion of the cable;

an outer insulator surrounding a portion of the inner insulator while exposing remaining portions to an outside of the outer insulator;

means for securing the inner insulator and the outer insulator together in said front-to-back direction, and a metallic cover enclosing a front portion of the inner insulator and secured to the exposed remaining portions via glue.

12. The cable connector assembly as claimed in claim 11, wherein a front end region of the outer insulator is located in front of the inner insulator.

13. The cable connector assembly as claimed in claim 12, wherein the cover encloses said front end region of the outer insulator.

14. The cable connector assembly as claimed in claim 13, further including an insulating block received within a rear portion of the shell to cover joints between the rear soldering sections and the corresponding wires, wherein said front end region is located in front of the insulating block in said front-to-back direction.

15. The cable connector assembly as claimed in claim 11, wherein the cover forms a front end against which a front end of the outer insulator abuts forwardly.

16. The cable connector assembly as claimed in claim 11, wherein a rearmost section of the shell extends into the inner insulator.

17. The cable connector assembly as claimed in claim 11, wherein said exposed remaining portions are two projections opposite to each other in a direction perpendicular to said front-to-back direction.

18. The cable connector assembly as claimed in claim 11, further including an insulating block received within a rear portion of the shell to cover joints between the rear soldering sections and the corresponding wires.

19. The cable connector assembly as claimed in claim 11, wherein said means includes a cutout in the outer insulator with a projection of the inner insulator snugly received therein.

* * * * *